US006786255B1

(12) United States Patent
Lee

(10) Patent No.: US 6,786,255 B1
(45) Date of Patent: Sep. 7, 2004

(54) BOTTLED WATER DISCHARGING APPARATUS

(75) Inventor: Yeon Seok Lee, Seoul (KR)

(73) Assignee: Banpo Marketing Co., Ltd., Seoul (KR)

( * ) Notice: Subject to any disclaimer, the term of this patent is extended or adjusted under 35 U.S.C. 154(b) by 1 day.

(21) Appl. No.: 10/467,471

(22) PCT Filed: Nov. 9, 2002

(86) PCT No.: PCT/KR02/02086

§ 371 (c)(1),
(2), (4) Date: Jun. 11, 2004

(87) PCT Pub. No.: WO03/050032

PCT Pub. Date: Jun. 19, 2003

(30) Foreign Application Priority Data

Dec. 11, 2001 (KR) ..... 2001-78227
Apr. 17, 2002 (KR) ..... 2002-20892

(51) Int. Cl.[7] ..... B65B 1/04

(52) U.S. Cl. ..... 141/351; 141/286; 141/82; 222/146.1

(58) Field of Search ..... 141/351, 98, 82, 141/286, 2, 18; 222/146.1, 146

(56) References Cited

U.S. PATENT DOCUMENTS 5,031,676 A 7/1991 Ulm
5,431,205 A 7/1995 Gebhard
5,526,961 A * 6/1996 Burrows ..... 222/185.1
6,139,726 A * 10/2000 Greene ..... 210/94
6,532,760 B2 * 3/2003 Davis ..... 62/392

FOREIGN PATENT DOCUMENTS

GB 2022979 12/1979

* cited by examiner

*Primary Examiner*—Steven O. Douglas
(74) *Attorney, Agent, or Firm*—Needle & Rosenberg, P.C.

(57) ABSTRACT

Disclosed herein is a bottled water discharging apparatus (2). The bottled water discharging apparatus (2) includes a water bottle support (4), packing cover (11) and a manifold (16). The water bottle support (4) is put on the mouth of a water bottle (1), and includes a sterilizing means, an air inflow pipe (6), a lid member (8) having a water outlet a closing member (9), and an elastic member (10). The hopper-shaped packing cover (11) is put on the opening of a bottled water disperser (2) to accommodate the water bottle the support (4) put on the water bottle (1) and is provided at its edge with a flange (12) to be held by the opening of the bottled water dispenser. The flange (12) is integrated with a packing member (13). The manifold (16) tightly is inserted into the center of the bottom of the packing cover (11) to be connected to hot and cold water containers (14), (15). The manifold (16) is upwardly projected from the bottom of the packing cover (11) to lift up the closing member (9) of the water bottle support (4) and open the water outlet of the water bottle support (4).

3 Claims, 8 Drawing Sheets

【FIG. 1】
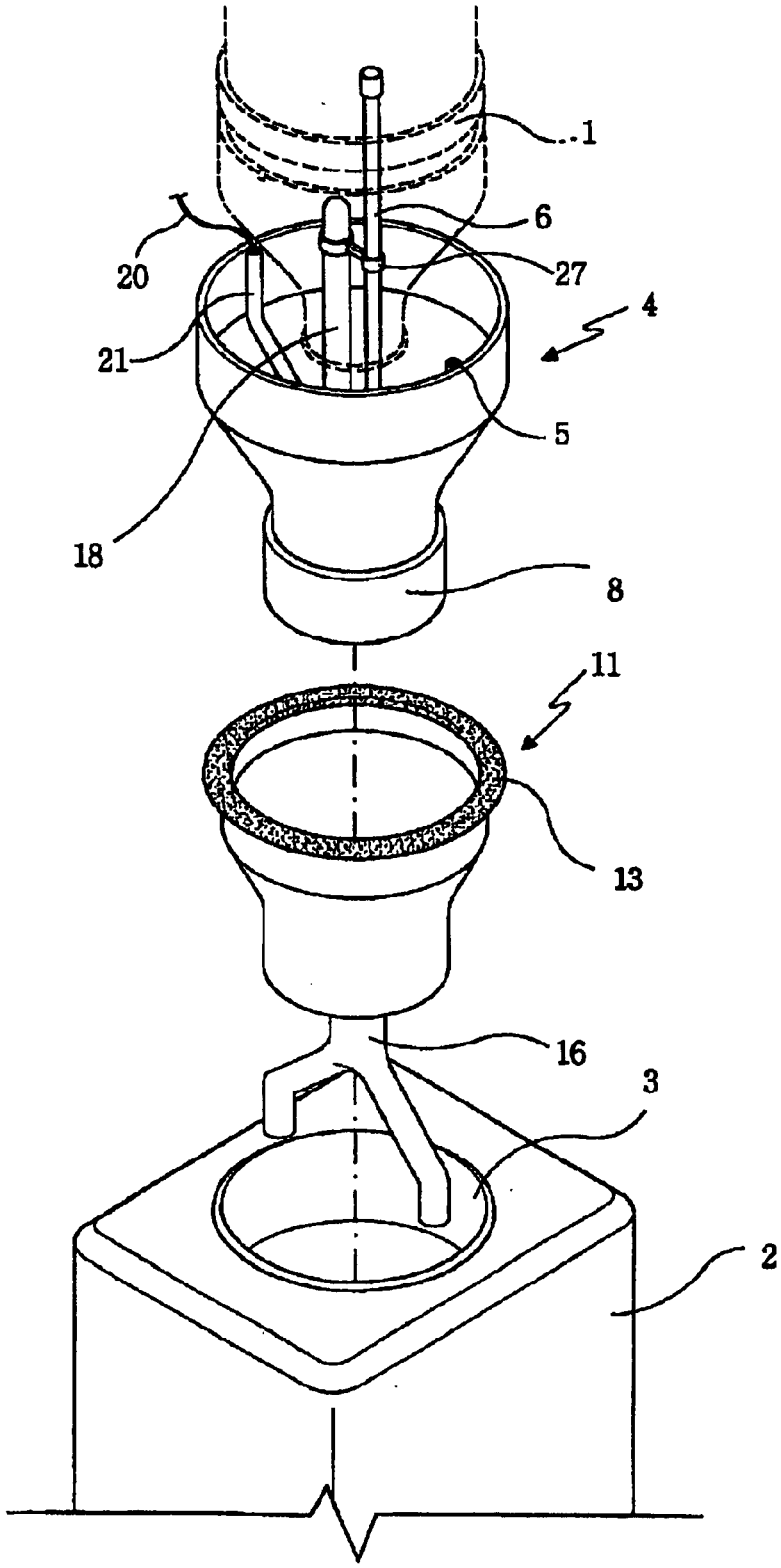

【FIG 2】
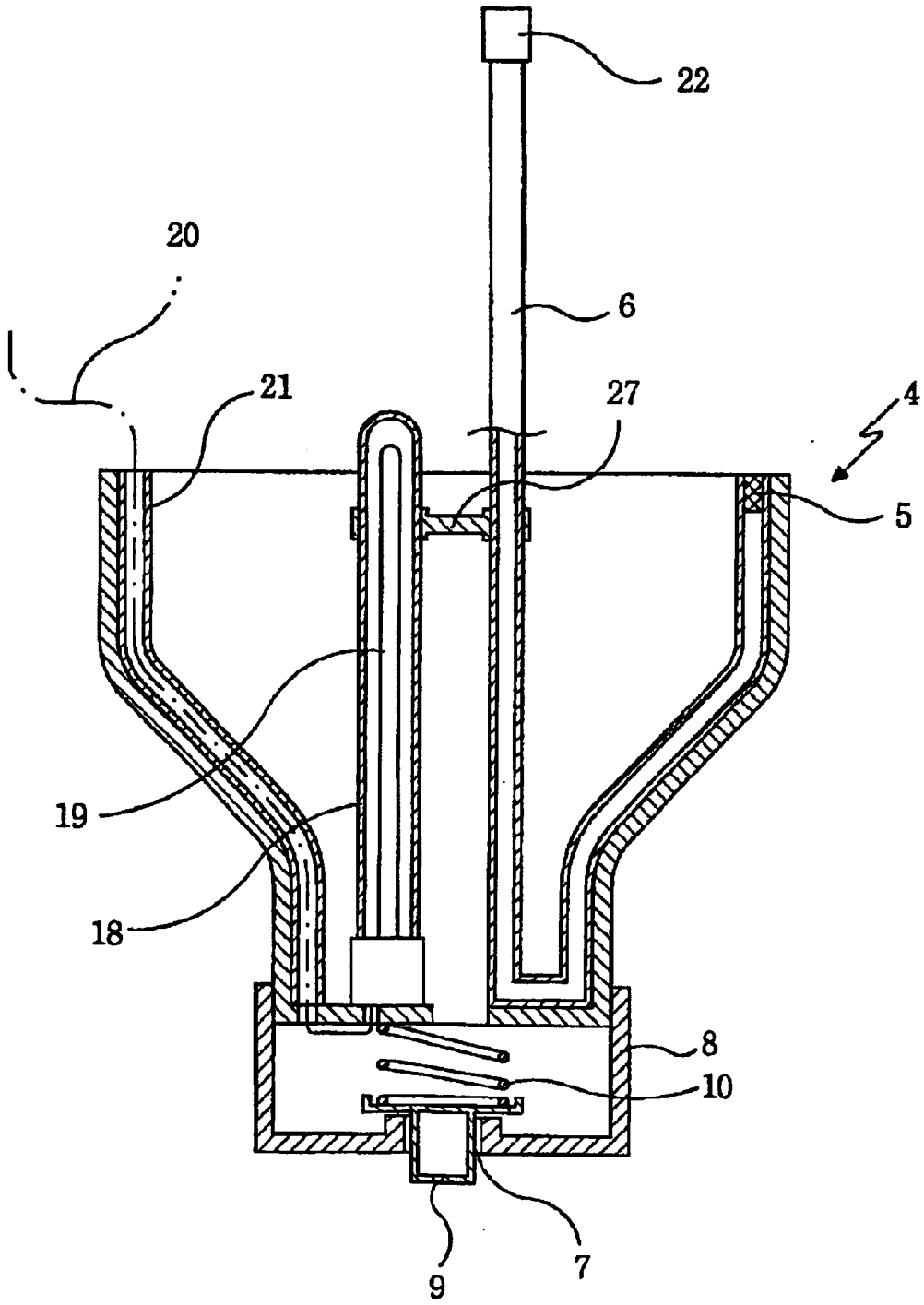

【FIG 3】
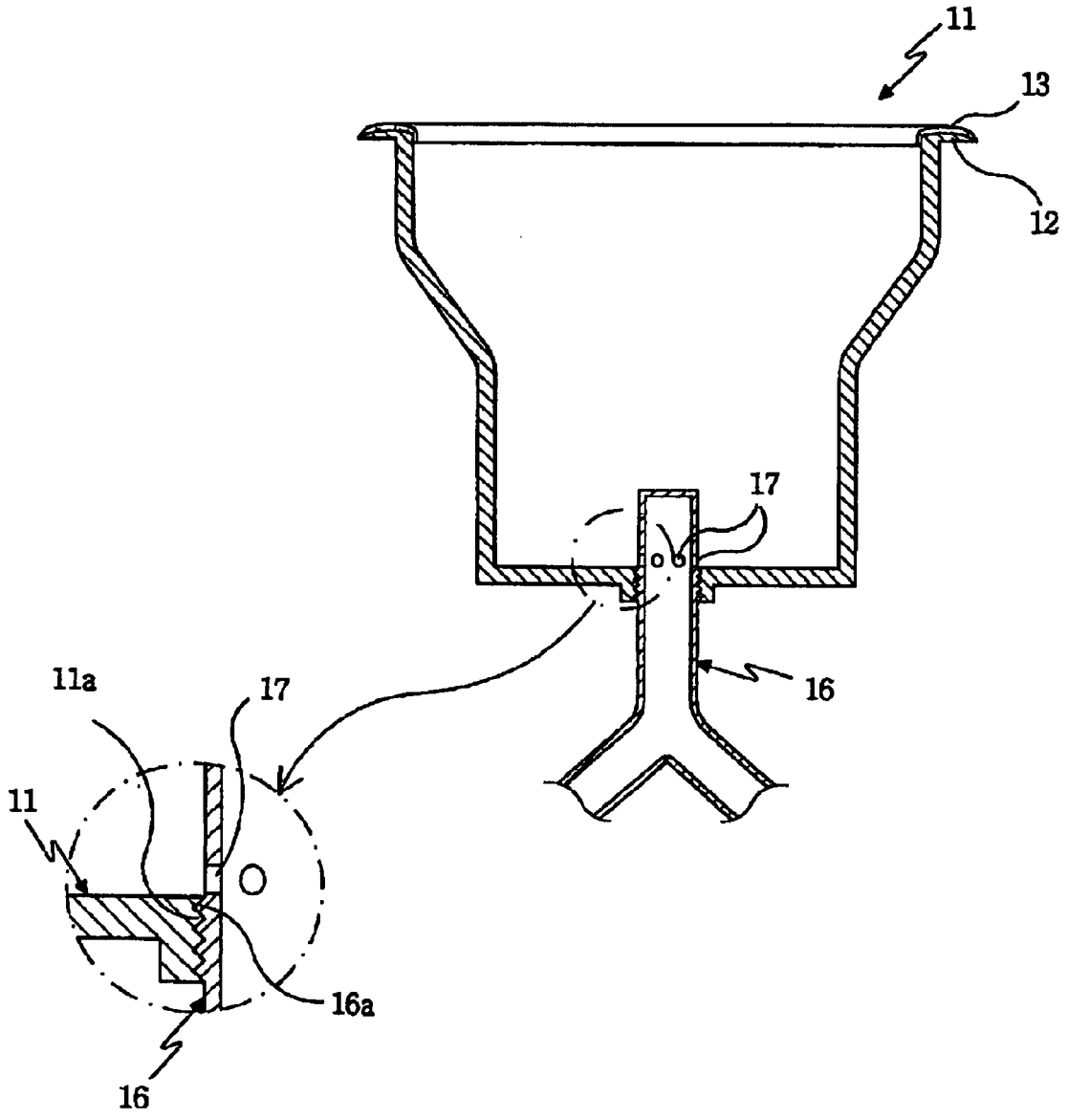

【FIG 4】
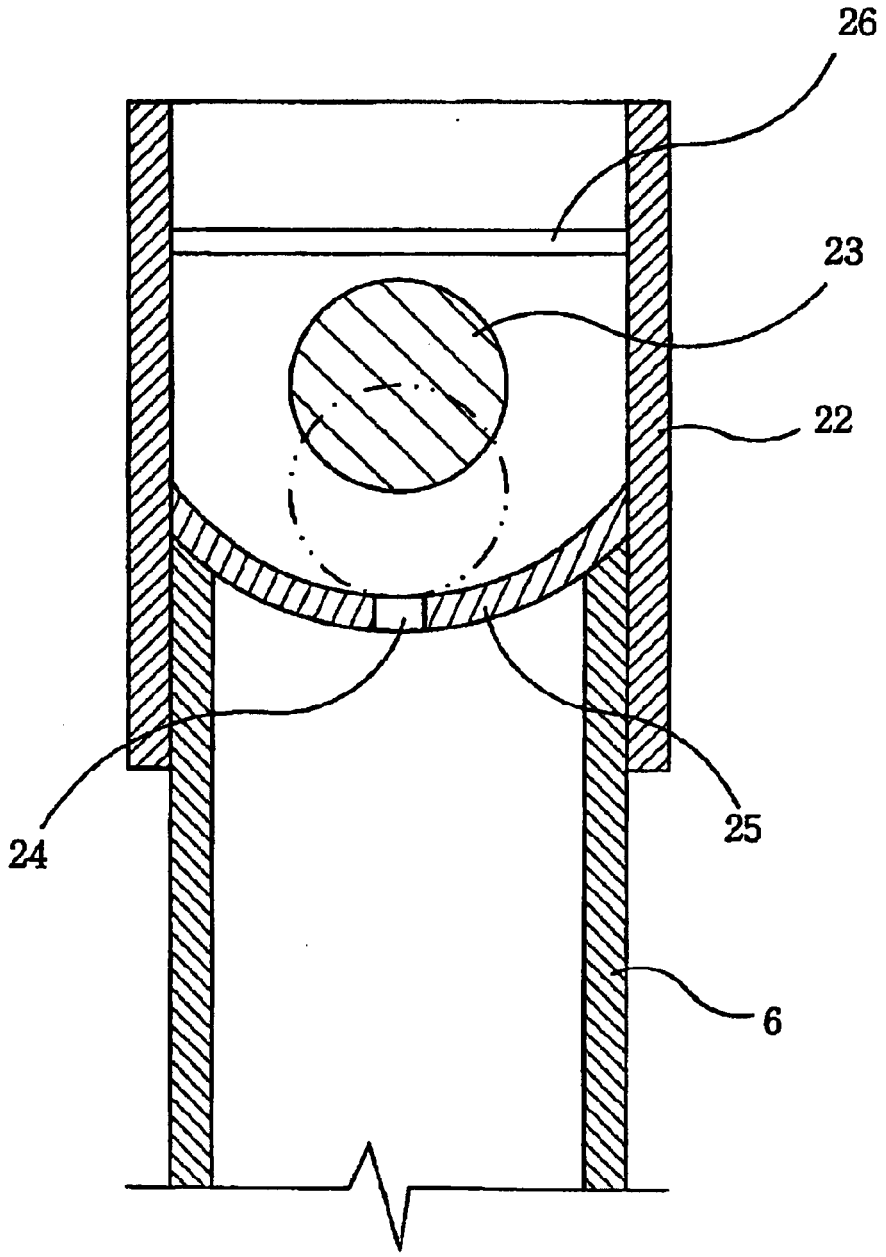

【FIG 5】
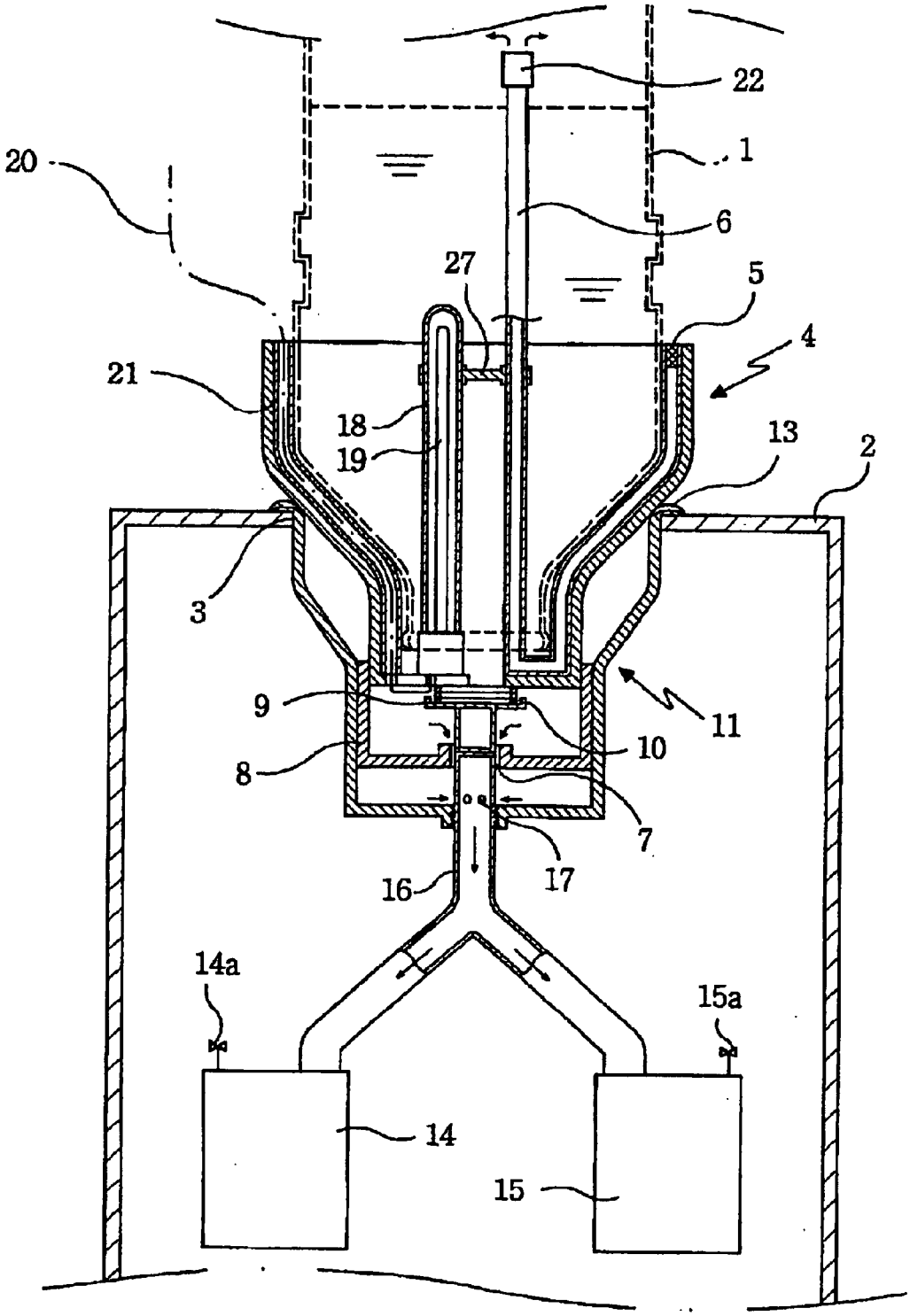

【FIG 6】
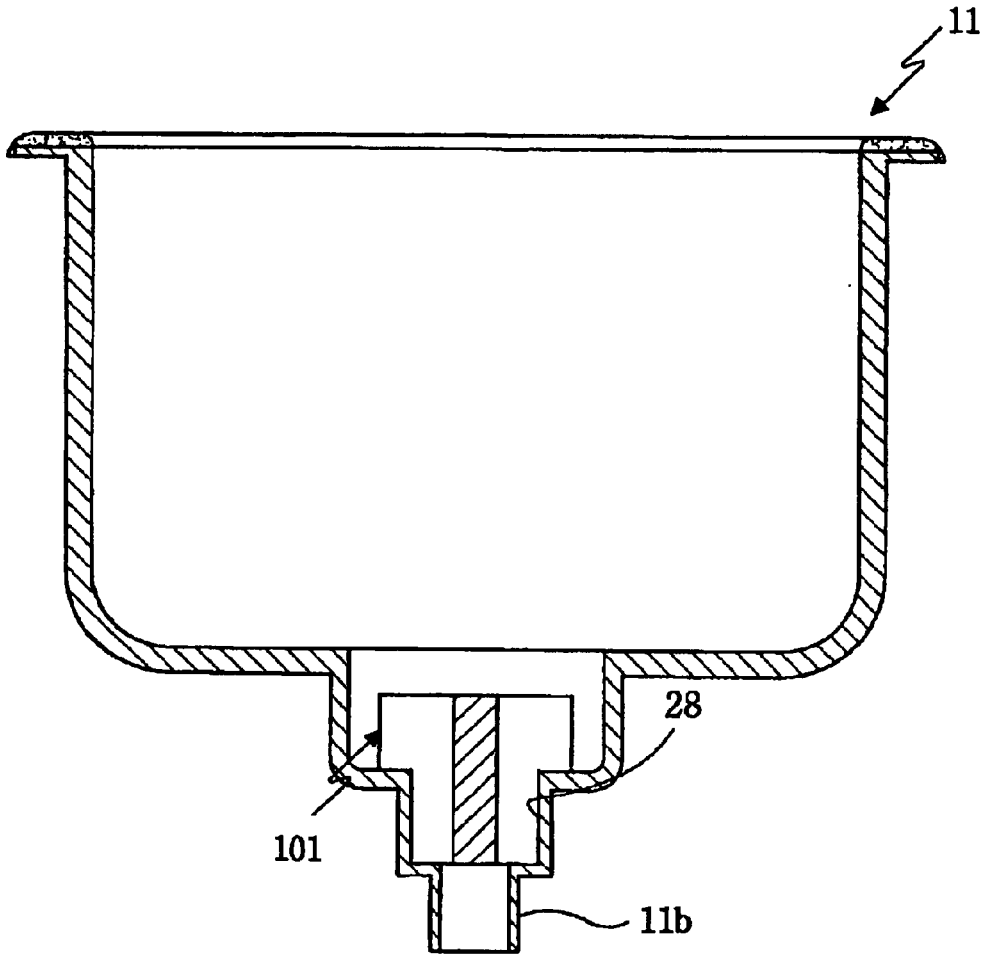

【FIG 7】
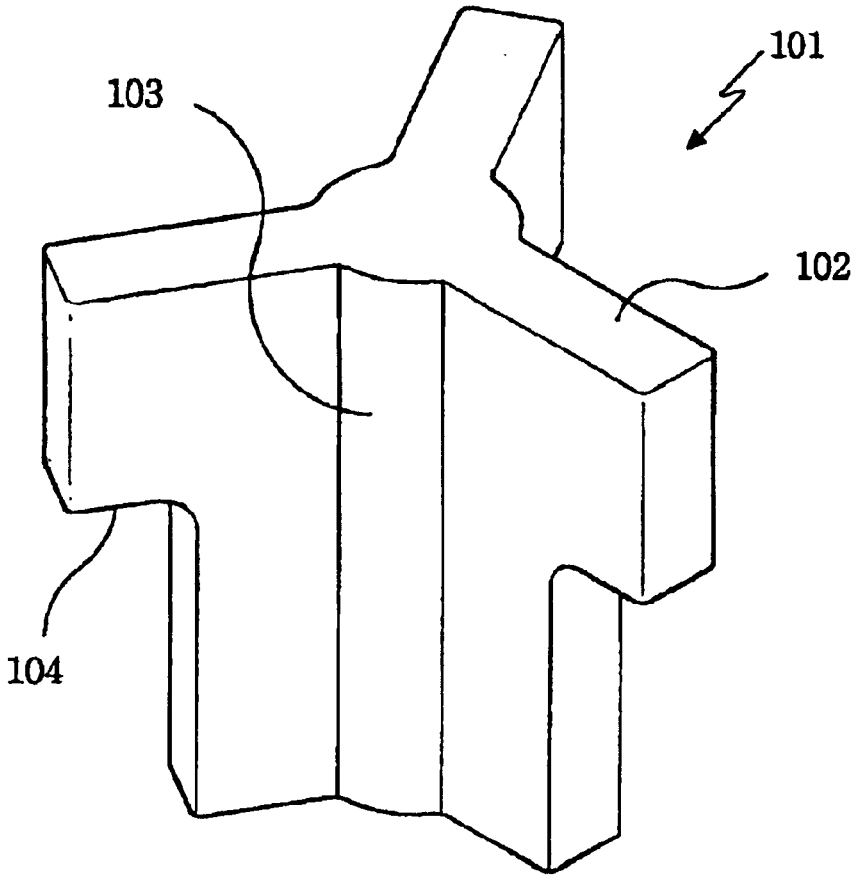

【FIG 8】
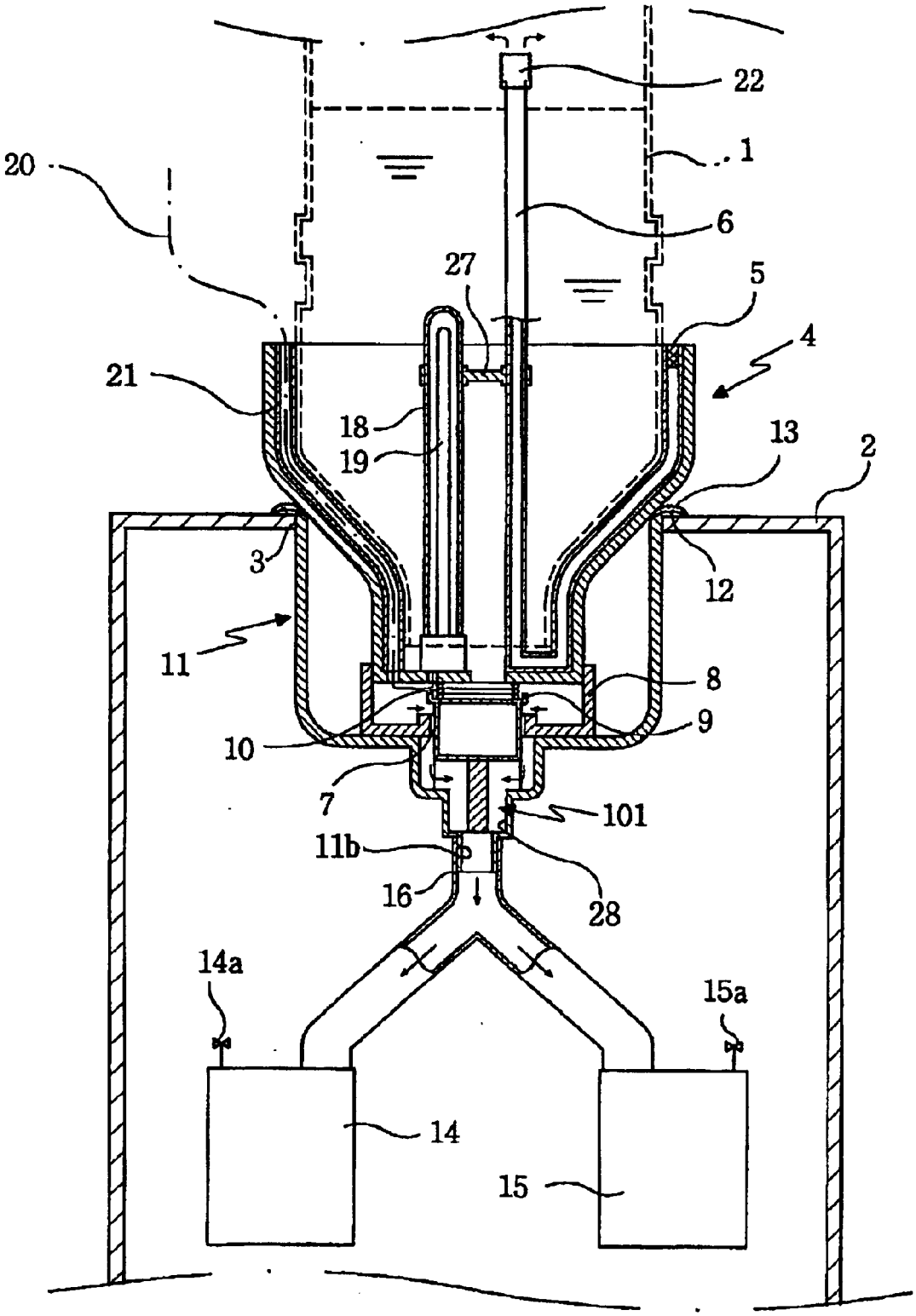

BOTTLED WATER DISCHARGING APPARATUS

CROSS REFERENCE TO RELATED APPLICATIONS

The present application claims priority to Republic of Korea Patent Application No. 2001-78227, filed Dec. 11, 2001, and to Republic of Korea Patent Application No. 2002-20892, filed Apr. 17, 2002, which applications are incorporated herein fully by this reference.

TECHNICAL FIELD

The present invention relates generally to a bottled water discharging apparatus, and more particularly to a bottled water discharging apparatus, in which a water bottle support is put on a water bottle to prevent the leakage of bottled water, and a packing cover is provided to prevent the contact of the bottled water with outside air so that bacterial contamination of the bottled water is prevented.

BACKGROUND ART

As well known, bottled water is purified water that contains inorganic substance, such as minerals, and is therefore beneficial to the human body. However, the bottled water may be easily contaminated with harmful bacteria in the process of being stored in and discharged from a water bottle, differently from boiled water.

In the meantime, bottled water is delivered to a home or business place in a scaled water bottle, and the water bottle is opened and inserted into the opening of a bottled water dispenser to supply hot or cold water. When the water bottle is inserted into the bottled water dispenser, bottled water may be easily spilt from the water bottle. Additionally, while the water bottle is being inserted into the bottled water dispenser, contaminated air may be easily infiltrated into the water bottle, so bottled water contained in the water bottle may be easily contaminated with bacteria.

DISCLOSURE OF THE INVENTION

Accordingly, the present invention has been made keeping in mind the above problems occurring in the prior art, and an object of the present invention is to provide a bottled water discharging apparatus, in which an air inflow pipe is arranged in tight contact with the inside surface of a water bottle support without exposure to the outside, a packing cover including a packing member is put on the opening of a bottled water dispenser to be brought into tight contact with the water bottle support and a manifold connected to hot and cold water containers is inserted into the center of the packing cover to lift up the closing member of the water bottle support by the upper end of the manifold so as to selectively open and close the water outlet of the water bottle support. Accordingly, there can be provided the bottled water discharging apparatus, in which the opening of the bottled water dispenser is completely sealed by the packing cover to prevent bacterial contamination, the air inlet pipe is not exposed to the outside to present a neat appearance and not to require the alteration of an existing bottled water dispenser, and the manifold is inserted into the packing cover to eliminate a separate water outlet pipe drawn from the bottled water discharging apparatus and therefore provide a compact water discharging structure.

In order to accomplish the above object, the present invention provides a bottled water discharging apparatus, including a water bottle support put on the mouth of a water bottle, the water bottle support including a sterilizing means, an air inflow pipe bent to come into tight contact with the inside surface of the water bottle support, a lid member having a water outlet, a closing member designed to selectively open and close the water outlet, and an elastic member arranged to elastically support the closing member, a hopper-shaped packing cover put on the opening of a bottled water dispenser to accommodate the water bottle support put on the water bottle, the packing cover being provided at its edge with a flange to be held by the opening of the bottled water dispenser, the flange being integrated with a packing member, and a manifold tightly inserted into the center of the bottom of the packing cover to be connected to hot and cold water containers, the manifold being upwardly projected from the bottom of the packing cover to lift up the closing member of the water bottle support and open the water outlet of the water bottle support.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an exploded perspective view of a bottled water discharging apparatus in accordance with the present invention;

FIG. 2 is a sectional view of a water bottle support in accordance with the present invention;

FIG. 3 is a sectional view of a packing cover in accordance with the present invention;

FIG. 4 is a sectional view of a water inflow preventing means in accordance with the present invention;

FIG. 5 is a sectional view of a bottled water dispenser equipped with the bottled water discharging apparatus in accordance with the present invention;

FIG. 6 is a sectional view of a packing cover in accordance with another embodiment of the present invention;

FIG. 7 is a perspective view of a pushing member in accordance with the second embodiment of the present invention; and FIG. 8 is a sectional view of a bottled water dispenser equipped with a bottled water discharging apparatus in accordance with the second embodiment of the present invention.

BEST MODE FOR CARRYING OUT THE INVENTION

Reference now should be made to the drawings, in which the same reference numerals are used throughout the different drawings to designate the same or similar components.

Referring to the accompanying drawings, bottled water discharging apparatuses in accordance with embodiments of the present invention are described in detail below.

As illustrated in FIGS. 1 to 3, a bottled water discharging apparatus in accordance with the present invention includes a water bottle support 4, a packing cover 11 and manifold 16.

The water bottle support 4 is put on the mouth of a water bottle 1. The water bottle support 4 includes a sterilizing means designed to sterilize the inside of the water bottle 1, an air inflow pipe 6 provided at its first with an air filer 5 and at its second end with an air inflow preventing means, a lid member 8 comprised of a hollow space and an water outlet 7, a closing member 9 vertically movably inserted into the water outlet 7 to selectively open and close the water outlet 7 and an elastic member 10 arranged to elastically support the closing member 9. The air inflow pipe 6 is bent to come into tight contact with the inside surface of the water bottle support 4.

The hopper-shaped packing cover 11 is put on the opening 3 of a bottled water dispenser 2 to receive the water bottle support 4 put on the water bottle 1. The packing cover 11 is provided at its edge with a flange 12 to be held by the opening 3 of the bottled water dispenser 2. The flange 12 is integrated with a packing member 13 to allow the packing cover 11 to come into tight contact with the water bottle support 4 put on the water bottle 1.

The manifold 16 is tightly inserted into the center of the bottom of the packing cover 11 to be connected to hot and cold water containers 14 and 15. The manifold 16 is upwardly projected from the bottom of the packing cover 11 to lift up the closing member 9 of the water bottle support 4 and open the water outlet 7 of the water bottle support 4, and is provided at its side over the bottom of the packing cover with a plurality of water outlet holes 17.

In this case, the sterilizing means has a structure in which an ultraviolet ramp 19 is contained in a quartz tube 18. A lead wire 20 is drawn to the outside along the sidewall of the water bottle support 4 through a coating tube 21. The water inflow preventing means, as illustrated in FIG. 4, includes a hollow cap 22 attached to the inlet end of the air inflow pipe 6, a ball 23 inserted into the hollow cap 22 to be vertically movable, a partition 25 provided with an air hole 24 that is selectively opened and closed by the ball 23, and a stopper 26 designed to restrict the movable distance of the ball 23.

In addition, threads 11*a* and 16*a* are formed on the packing cover 11 and the manifold 16, respectively, the manifold 16 is connected to a cold water container 14 and a hot water container 15, and the packing cover 11 is tightly fastened around the manifold 16. A support bar 27 may be interposed between the quartz tube 18 and the air inflow pipe 6 to maintain a constant interval therebetween.

Reference numerals 14*a* and 15*a* designate safety valves that are respectively connected to the hot and cold water containers 14 and 15 and serve to maintain appropriate pressure by relieving pressure when excessive pressure is applied in the hot and cold water container 14 and 15.

When the water bottle 1 is opened and seated into the water bottle support 4 equipped with the sterilizing means and the air inflow pipe 6, the closing member 9 closes the water outlet 7 of the plug 8. Additionally, the ball 23 of the water inflow preventing men is made to close the air inflow hole 24 formed in the partition 25 by the pressure of water generated in the interior of the air inflow pipe 6, so the inflow of water into the air inflow pipe 6 is prevented.

In the meantime, the. packing cover 11 is fitted into the input side 3 of the water dispenser 2. In this case, the manifold 16 is fixedly connected to the hot and cold water containers 14 and 15 before the fitting of the packing cover 11 into the opening 3 of the bottled water dispenser 2, and the packing cover 11 is fastened around the manifold 16 by engaging the threads 11*a* and 16*a* with each other in a screw manner. When the packing cover 11 is completely fastened around the manifold 16, a flange 12 formed along the upper edge of the packing cover 11 is held by the edge of the opening 3 of the bottled water dispenser 2.

In this state, when the water bottle 1 covered with the water bottle support 4 is inserted into the opening 3 of the bottled water dispenser 2, the water bottle 1 and the water bottle support 4 push the packing member 13 integrated with the flange 12 of the packing cover 11 as the outside surface of the water bottle support 4 is brought into contact with the edge of the packing cover 11. Accordingly, the water bottle support 4 and the packing cover 11 can be brought into tight contact with each other, so bacterial contamination that may occur through the opening 3 of the bottled water dispenser 2 can be prevented. At the same time that the water bottle 1 is put on the opening 3 of the bottled water dispenser 2, that is, the packing cover 11, the upper end of the manifold 16 inserted into and protruded from the center of the bottom of the packing cover 11 lifts up the closing member 9 of the water bottle support 4. Accordingly, the water outlet 7 of the water bottle support 4 is opened, so bottled water is primarily discharged from the water bottle 1 to the packing cover 11, and the bottled water discharged to the packing cover 11 is secondarily discharged to the manifold 16 through water outlet holes 17 formed in the manifold 16. Finally, the bottled water discharged into the manifold 16 flows into the cold or hot water container 14 or 15 through the manifold 16. Since the water outlet holes 17 are formed on the side of the manifold 16 above the bottom of the packing cover 11, the primarily discharged bottled water does not remain in the inside of the packing cover 11 but all the discharged bottled water flows into the cold or hot water container 14 or 15.

In that case, in order to smoothly discharge bottled water from the water bottle 1, air must be supplied into the water bottle 1 from the outside. The air is supplied through the air inflow pipe 6. Since the bottled water contained in the water bottle 1 may be contaminated if contaminated air is supplied into the water bottle 1, the air inflow pipe 6 is equipped in its inlet with an air filter 5 to allow fresh air free from bacteria to be supplied into the water bottle 1. When air flows into the water bottle 1 through the air inflow pipe 6, the ball 23 of the water inflow preventing means attached to the outlet end of the air inflow pipe 6 is lifted up by the pressure of the air and opens the air inflow hole 24 of the water inflow preventing means. Accordingly, fresh air can smoothly flow from the outside to the water bottle 1, so the discharge of the bottled water can be smoothly performed. That is, when the bottled water is discharged from the water bottle 1 to the outside, outside air can flow into the water bottle 1 to allow the bottled water to be smoothly discharged from the water bottle 1. In this case, the outside air is filtered by the air filter 5 to be purified and is completely free from bacteria, so the infiltration of bacteria into the water bottle 1 can be prevented. Additionally, the inside of the water bottle 1 is s by the sterilizing means, that is, the ultraviolet lamp 19, so the water contained in the water bottle 1 can be kept in a sanitary state.

Additionally, while the bottled water is discharged from the water bottle 1, the bottled water must be brought into contact with the sterilizing means, that is, the ultraviolet lamp 19, so any remaining bacteria may be killed by the ultraviolet lamp 19. Accordingly, sterilizing bottled water fire from bacteria may be discharged to a user, so the user may always drink safe and pure water.

Furthermore, the air inflow pipe 6 is brought into tight contact with the inside of the sidewall of the water bottle support 4 without exposure to the outside, so the present invention is advantageous in that it can be applied to an existing bottled water dispenser without alteration of the dispenser.

When the water bottle 1 and the water bottle support 4 are removed from the bottled water dispenser 2 to replace the water bottle 1 with anew one, move the bottled water dispenser 2 to another place or clean the bottled water dispenser 2, the closing member 9 lifted up by the upper end of the manifold 16 of the packing cover 11 is restored to its original position by the elastic force of an elastic member 10 and closes the water outlet 7 again Accordingly, the leakage of bottled water may be prevented, so the present invention provides safety and convenience of use.

FIGS. 6 to 8 are views showing another embodiment in accordance with the present invention. A stepped water outlet tube portion 28 is formed in the center of the bottom of a hopper-shaped packing cover 11, a pushing member 101 is inserted into the stepped water outlet tube portion 28, and a tubular protrusion 11*b* is downwardly extended from the stepped water outlet tube portion 28. In the pushing member 101, blades 102 are arranged in two or more directions to form water outlet passages 103 therebetween, and cuts 104 are formed in the lower portions of the blades 103 to be held in the stepped water outlet tube portion 28. The tubular protrusion 11*b* is fitted into a manifold 16 that is connected to hot and cold water containers 14 and 15.

In this state, when the water bottle 1 covered with the water bottle support 4 is inserted into the opening 3 of the bottled water dispenser 2, the water bottle support 4 and the water bottle 1 push the packing member 13 integrated with the flange 12 of the packing cover 11 as the outside surface of the water bottle support 4 is brought into contact with the edge of the packing cover 11. Accordingly, the water bottle support 4 and the packing cover 11 can be brought into tight contact with each other, so bacterial contamination that may occur through the opening 3 of the bottled water dispenser 2 can be prevented. At the same time that the water bottle 1 is put into the opening 3 of the bottled water dispenser 2, that is, on the packing cover 11, the upper end of the manifold 16 inserted into and protruded from the center of the bottom of the packing cover 11 lifts up the closing member 9 of the water bottle support 4. Accordingly, the water outlet 7 of the water bottle support 4 is opened, so bottled water is primarily discharged from the water bottle 1 to the packing cover 11, and the bottled water discharged to the packing cover 11 is secondarily discharged to the manifold 16 through the water outlet passages 103 formed between the blades 102 of the pushing member 101. Finally, the bottled water discharged into the manifold 16 flows into the cold or hot water container 14 or 15 through the manifold 16.

The second embodiment of the present invention has the same effects as the first embodiment of the present invention in that the apparatuses are conveniently used because the leakage of bottled water is prevented at the time of seating the water bottle 1 on the bottled water dispenser 2, and the discharge of the bottled water is smoothly carried out. This second embodiment is disadvantageous in that the pushing member 101 must be separately manufactured, but it is advantageous in that the thread 1a does not need to be formed on the packing cover 11, thus allowing the apparatus to be easily manufactured. Additionally, the manifold 16 requires no special configuration and is made of a flexible material to be smoothly fitted on the packing cover 11, so it can be easily manufactured and reduces manufacturing costs.

INDUSTRIAL APPLICABILITY

As described above, the present invention provides a bottled water discharging apparatus, in which the infiltration of bacteria into a water bottle is completely prevented because the opening of a bottled water dispenser covered with a packing cover is brought into tight contact with a water bottle support put on a water bottle while the water bottle is put on the bottled water dispenser. Additionally, the propagation of bacteria is prevented and bacteria are eliminated by a sterilizing means and an air inflow means provided in the water bottle support The leakage of bottled water is prevented because a closing member closes a water outlet when the water bottle is covered with the water bottle support. whereas the bottled water can be smoothly discharged and drunk by a user because the water outlet is opened when the water bottle covered with the water bottle support is inserted into the packing cover put on the bottled water dispenser. Furthermore, an air inflow pipe that defines a passage of air when the air flows into the water bottle to facilitate the discharge of the bottled water is constructed to be bent to come into tight contact with the inside surface of the water bottle support, so the apparatus of the present invention presents a neat appearance and can be easily applied to existing bottled water dispensers without the alteration of configuration.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bottled water discharging apparatus, comprising:

a water bottle support put on a mouth of a water bottle, the water bottle support including a sterilizing means designed to sterilizing an inside of the water bottle, an air inflow pipe provided at its first end with an air filter and at its second end with an air inflow preventing means and bent to come into tight contact with an inside surface of the water bottle support, a lid member comprised of a hollow space and a water outlet, a closing member vertically movably inserted into the water outlet to selectively open and close the water outlet, and an elastic member arranged to elastically support the closing member;

a hopper-shaped packing cover put on an opening of a bottled water dispenser to accommodate the water bottle support put on the water bottle, the packing cover being provided at its edge with a flange to be held by the opening of the bottled water dispenser, the flange being integrated with a packing member to allow the packing cover to come into tight contact with the water bottle support put on the water bottle; and a manifold tightly inserted into the center of the bottom of the packing cover to be connected to hot and cold water containers, the manifold being upwardly projected from the bottom of the packing cover to lift up the closing member of the water bottle support and open the water outlet of the water bottle support and being provided at its side over the bottom of the packing cover with a plurality of water outlet holes.

2. The bottled water discharging apparatus according to claim 1, wherein the packing cover and the manifold are interlocked with each other in a screw manner.

3. A bottled water discharging apparatus, comprising:

a water bottle support put on a mouth of a water bottle, the water bottle support including a sterilizing means designed to sterilize an inside of the water bottle, an air inflow pipe provided at its first end with an air filter and at its second end with an air inflow preventing means, a lid member comprised of a hollow space and a water outlet, a closing member vertically movably inserted into the water outlet to selectively open and close the water outlet, and an elastic member arranged to elastically support the closing member, the air inflow pipe being bent to come into tight contact with an inside sure of the water bottle support;

a hopper-shaped packing cover put on an opening of a bottled water dispenser to accommodate the water bottle support put on the water bottle, the packing cover being provided at its edge with a flange to be held by the opening of the bottled water dispenser and at a center of its bottom with a stepped water outlet tube portion, the flange being integrated with a packing member to allow the packing cover to come into tight contact with the water bottle support put on the water bottle, the stepped water outlet tube portion being equipped in its interior with a pushing member and being connected to a tubular protrusion, the pushing member including blades arranged in two or more directions to form water outlet passages therebetween and cuts formed in lower portions of the blades to be held in the stepped water outlet tube portion; and a manifold tightly fitted around the tubular protrusion of the packing cover to be connected to hot and cold water containers.

* * * * *